US005794452A

United States Patent [19]

Black et al.

[11] Patent Number: 5,794,452

[45] Date of Patent: Aug. 18, 1998

[54] HOT GAS BYPASS SYSTEM FOR AN ICEMAKER

[75] Inventors: William J. Black; Matthew W. Allison, both of Gurnee; Melvin A. Baker, Grayslake; Gary L. Van Riper, Wildwood, all of Ill.

[73] Assignee: Scotsman Group, Inc., Vernon Hills, Ill.

[21] Appl. No.: 846,860

[22] Filed: May 1, 1997

[51] Int. Cl.[6] ..... F25C 5/10

[52] U.S. Cl. ..... 62/73; 62/278; 62/352

[58] Field of Search ..... 62/73, 81, 278, 62/352

[56] References Cited

U.S. PATENT DOCUMENTS 5,575,158 11/1996 Vogel ..... 62/278

5,584,186 12/1996 Hirano ..... 62/278

*Primary Examiner*—William E. Tapolcai

*Attorney, Agent, or Firm*—Harness, Dickey & Pierce, PLC

[57] ABSTRACT

An icemaker incorporating a hot gas bypass system for introducing a supplemental quantity of refrigerant from a condenser into a compressor of the icemaker during a harvest cycle. The system includes a harvest bypass valve disposed in a bypass conduit coupled between an input port of the compressor and the inlet of a remotely disposed condenser. The harvest bypass valve is opened by a system controller of the icemaker during a harvest cycle which allows refrigerant in the condenser to migrate back into the input port of the compressor during the harvest cycle. In this manner, it can be insured that a sufficient quantity of refrigerant is available to carry out the harvest cycle. The adding of a supplemental quantity of refrigerant is further accomplished through a single valve and does not add appreciably to the overall cost or complexity of the icemaker.

12 Claims, 1 Drawing Sheet

HOT GAS BYPASS SYSTEM FOR AN ICEMAKER

BACKGROUND OF THE INVENTION

1. Technical Field

This invention relates to icemakers, and more particularly to an icemaker having a system for supplying an additional quantity of hot vaporous refrigerant from a remotely disposed condenser to a compressor to assist in carrying out a harvest cycle in which one or more evaporators of the icemaker are warmed to release ice cubes which have formed thereon.

2. Discussion

Icemakers are used in a wide variety of commercial and residential applications. In commercial applications, where such icemakers are called upon to produce very large quantities of ice on a daily basis, such icemakers often include a remotely located condenser. The condenser is often located some distance (e.g., up to 75 feet) from the compressor of the icemaker, and is often located outdoors such as on a roof-top of a building. Locating large condensers outdoors is often necessary to adequately allow heat radiated from the condenser to be dissipated.

When large, remotely disposed condensers are used in an icemaking system, one problem is that the refrigerant is driven from the roof-top mounted condenser or a receiver of the system back into the compressor either directly or through the evaporators of the system, thus flooding the compressor during the harvest cycle.

One attempt at remedying this problem has been to install one or more check valves between the compressor and the condenser, and between the condenser and the receiver, in an effort to prevent refrigerant from migrating from the condenser back to the compressor during the harvest cycle. The problem with this arrangement, however, is that the refrigerant is "locked " in the high pressure loop of the system (i.e., the condenser and receiver and the conduits coupling these components), which leaves an inadequate amount of refrigerant in the circulating low pressure loop (i.e., comprising the compressor, evaporator and associated conduits coupling these components), preventing an adequate harvesting of the ice cubes which have formed on the evaporator. An insufficient quantity of refrigerant can therefore lead to inadequately long harvest times, thus reducing the output of the icemaker to unacceptably low quantities of ice.

Other attempts at remedying this problem have involved the use of one or more valve assemblies which include a pressure regulating valve disposed between an inlet or suction side of a compressor and a discharge side of the compressor to automatically cause vaporous refrigerant to be drawn in at the inlet side of the compressor when the suction pressure at the inlet side drops below a predetermined level. Such a system is disclosed in U.S. Pat. No. 4,774,815 to Schlosser. The obvious drawback with this type of system, however, is the need for a pressure regulating type of valve and the dependence on the suction pressure at the compressor inlet for controlling the points or times at which refrigerant is injected back into the suction side of the compressor. Should the suction pressure of the compressor vary outside of an expected range for any reason, this form of system might not supply an adequate amount of refrigerant to perform an adequate harvest cycle. It also may provide too much refrigerant resulting in floodback to the compressor.

For the above reasons, it would be highly desirable to provide some system which can be used to introduce an additional quantity of refrigerant back into an inlet or suction port of a compressor of an icemaker, automatically, and during a harvest cycle, to insure that an adequate supply of refrigerant is available to complete the harvest cycle within a desired time.

It is a further object of the present invention to provide a system for supplying additional refrigerant to a suction or inlet port of a compressor of an icemaker to assist in executing a harvest cycle, wherein the system for introducing the additional refrigerant is not dependent on the suction pressure of the suction or inlet port of the compressor. Instead, it is an object to provide a system which operates to inject an additional quantity of refrigerant into the inlet side of a compressor simply for a predetermined time during a harvest cycle, and regardless of the degree of suction pressure at the inlet side of the compressor.

It is still a further object of the present invention to provide a method and apparatus for supplying additional refrigerant to a compressor of an icemaker having a remotely disposed condenser, where only a single valve is needed for injecting a quantity of refrigerant back into the suction or inlet side of the compressor during the harvest cycle of the icemaker.

SUMMARY OF THE INVENTION

The above and other objects are provided by an icemaker having a harvest bypass valve system and method of operation in accordance with preferred embodiments of the present invention. The preferred method involves controlling a valve disposed between an input or suction port of a compressor and an inlet of a condenser. It will be appreciated that the condenser will be disposed remotely, such as on a roof-top, from the remainder of the icemaker with which it is associated.

The preferred method involves using a system controller to open the valve during a harvest cycle of the icemaker to allow refrigerant to migrate from the condenser back into the suction or inlet port of the compressor. In this manner it can be assured that a sufficient supply of refrigerant will be available to carry out the harvest cycle within a desired time period.

The preferred embodiment of the present invention involves an icemaker having a harvest bypass valve disposed in a section of conduit leading from the suction or inlet port of a compressor of the icemaker to an inlet of the condenser. Again, the condenser is remotely located, such as on a roof-top, but it will be appreciated that the condenser need not necessarily be located a great distance or a great elevation above the icemaker. The harvest bypass valve comprises a solenoid actuated valve which is opened during the harvest cycle by the system controller of the icemaker to allow refrigerant to migrate back from the condenser into the suction or input port of the compressor for a predetermined time period. In this manner a sufficient quantity of refrigerant is assured to carry out the harvest cycle within a desired time period.

BRIEF DESCRIPTION OF THE DRAWINGS

The various advantages of the present invention will become apparent to one skilled in the art by reading the following specification and subjoined claims and by referencing the following drawing in which:

DETAILED DESCRIPTION OF THE PREFERRED EMBODIMENTS

Figure 1:
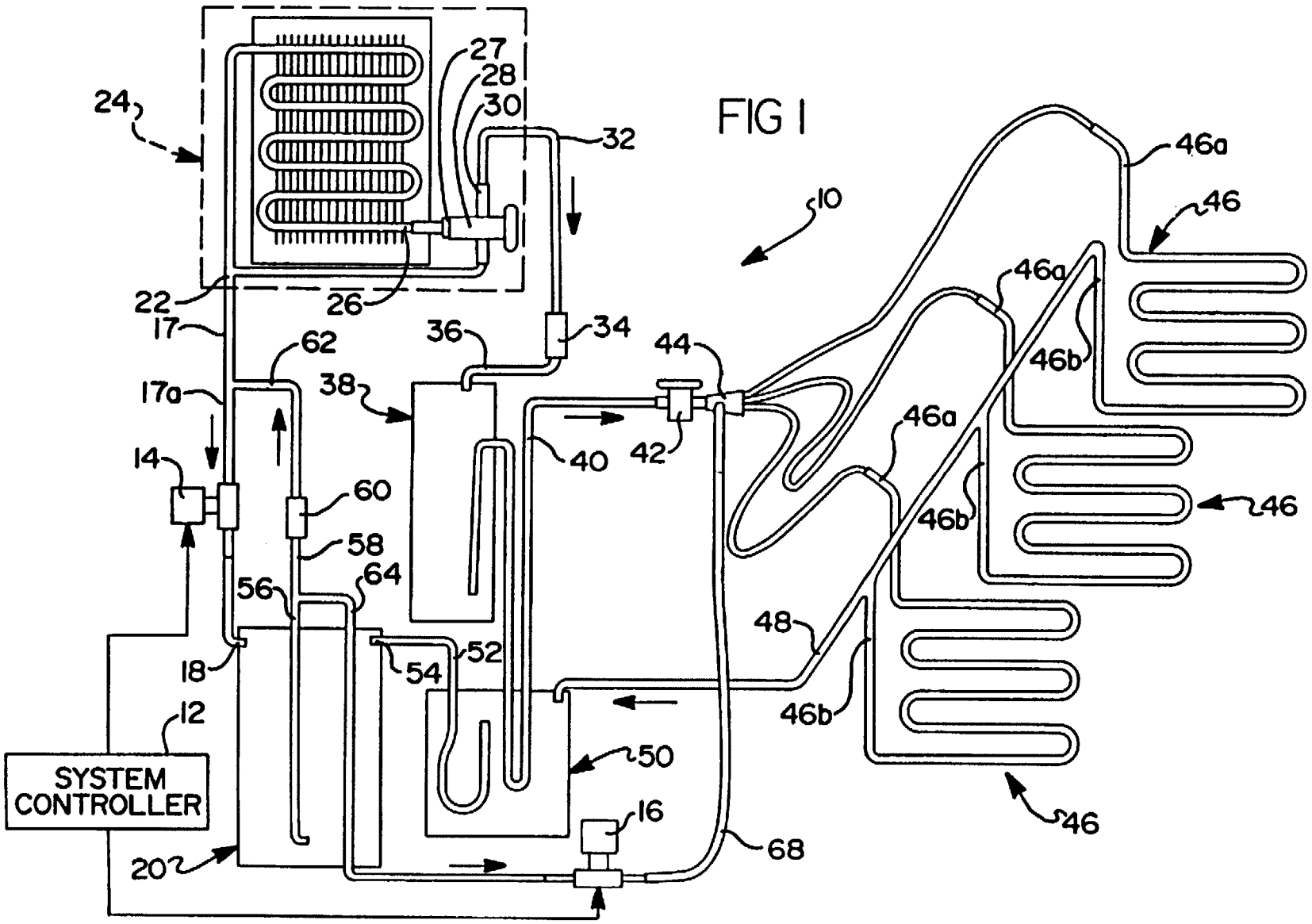
FIG. 1 is a simplified diagram of an icemaker in accordance with a preferred embodiment of the present invention.

Referring to FIG. 1, there is shown an icemaker 10 in accordance with a preferred embodiment of the present invention. The icemaker generally includes a system controller 12 which is electrically coupled to a harvest gas bypass valve 14 and a hot gas valve 16. The harvest gas bypass valve 14 is an electrically actuated solenoid valve disposed in series with a bypass conduit 17 which extends from a suction or inlet port 18 of a compressor 20 to an inlet 22 of a remotely disposed condenser 24. Portion 17*a* of conduit 17 also acts as a bypass conduit during the harvest cycle of the icemaker 10.

The condenser 24 is typically located some distance from the compressor 20, and typically on a building roof-top or outside of a building in which the icemaker 10 is disposed. An outlet 26 of the condenser 24 is coupled to a first input 27 of a conventional head pressure control valve 28. The head pressure control valve 28 has an output 30 coupled to a conduit 32, which is in turn coupled to a one-way check valve 34. The check valve 34 is in turn coupled to a conduit 36 which extends into a receiver 38 for containing liquid refrigerant discharged from the condenser 24. The liquid refrigerant is drawn out of the receiver 38 through conduit 40 and through a thermostatic expansion valve 42 to a refrigerant distributor 44. The liquid refrigerant is then drawn through the inlet 46*a* of each one of a plurality of evaporators 46 to chill the evaporators 46. Gaseous refrigerant leaves each of the evaporators 46 at an outlet 46*b* of each and returns through conduit 48 to an accumulator 50. The compressor 20 draws the vaporous refrigerant out of the accumulator 50 through a conduit 52 and into a suction or inlet port 54. The vaporous refrigerant is then compressed and subsequently discharged from discharge port 56 of the compressor 20 through a discharge conduit 58, a one-way check valve 60, and a conduit 62 which is teed into conduit 17 upstream of the condenser inlet 22. A conduit 64 is also teed into the conduit 58 upstream of the check valve 60 to direct discharged, hot vaporous refrigerant from the discharge port 56 to a hot gas valve 16. The hot gas valve 16 is a solenoid valve which is turned on by the system controller 12 to permit the flow of hot vaporous refrigerant through conduit 68, to the refrigerant distributor 44, and into the evaporators 46 during the harvest cycle.

In operation, once the ice formations which have formed on the evaporators 46 are of sufficient size, the harvest cycle of the icemaker 10 is entered. The system controller 12 opens the hot gas valve 16 to permit hot vaporous refrigerant discharged from the compressor 20 at discharge port 56 to flow through conduit 64, valve 16, conduit 68, refrigerant distributor 44 and into each of the evaporators 46 through inlets 46*a*. It will be appreciated that the pressure which is produced by the roof-top location of the condenser 24 is such that all of the vaporous refrigerant discharged from the compressor at discharge port 56 is directed into conduit 64. The one-way check valve 60 prevents the refrigerant in conduit 62 from combining with the refrigerant flowing through the hot gas valve 16 and back into the compressor 20 through the suction port 54.

When the harvest cycle is initiated, the system controller 12 also opens harvest bypass valve 14 for a predetermined time period. This permits refrigerant in the conduit 17 and the condenser 24 to migrate back into the input port 18 through the bypass portion 17*a* of conduit 17. In this manner, an additional quantity of refrigerant can be automatically introduced into the compressor 20 to insure sufficient refrigerant to carry out the harvest cycle within a predetermined desired time period. In the preferred embodiment, the system controller 12 monitors the compressor discharge temperature through a conventional temperature sensor (not shown). The system controller 12 determines the amount of time to open the harvest bypass valve 14 based on the discharge temperature during the freezing portion of the ice making cycle. Generally, the higher the discharge temperature of the vaporous refrigerant the shorter the time internal that the bypass valve 14 needs to be held open. The system controller 12 then opens the harvest bypass valve 14 at the start of the harvest cycle. In the preferred embodiment the harvest bypass valve 14 is held open during the harvest cycle for a time preferably between about 3 seconds–12 seconds. It will be appreciated, however, that this time period could vary outside of this range if needed.

It will be appreciated, then, that the icemaker 10, through the control of the harvest bypass valve 14, automatically is able to admit a supplemental amount of refrigerant back into the compressor 20 to insure that sufficient refrigerant is present to carry out the harvest cycle within a desired time. The icemaker 10 therefore does not rely on pressure regulating devices or various other arrangements which introduce significant mechanical complexity and cost into the icemaker 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for providing additional refrigerant to a compressor of an icemaker during a harvest cycle of an icemaking process, said method comprising the steps of:

beginning a harvest cycle;

opening a harvest gas bypass valve disposed intermediate an inlet side of a condenser and an input side of said compressor for a predetermined time during said harvest cycle to permit a supplemental amount of vaporous refrigerant to be supplied to said compressor from said condenser; and after said predetermined time has expired, closing said harvest gas bypass valve.

2. The method of claim 1, further comprising the steps of:

sensing the discharge temperature of said compressor; and opening said harvest gas bypass valve for a predetermined time based on said discharge temperature.

3. The method of claim 2, wherein the step of opening said harvest gas bypass valve for a predetermined time comprises the step of opening said harvest gas bypass valve for a time of between about 3 seconds and 12 seconds.

4. The method of claim 1, further comprising the step of disposing a one-way check valve between said inlet side of said condenser and a conduit leading to a hot gas valve for supplying vaporous refrigerant from a discharge port of said compressor to said hot gas valve, said check valve operating to prevent the entry of said vaporous refrigerant to said hot gas valve and flooding of said compressor.

5. A method for providing additional refrigerant to a compressor of an icemaker to assist in carrying out a harvest cycle of an icemaking process; said method comprising the steps of:

causing said icemaker to enter a harvest cycle in which hot vaporous refrigerant from a discharge port of said compressor is to be directed through an evaporator of said icemaker;

opening a hot gas valve disposed intermediate said discharge port of said compressor and said inlet of said evaporator to enable said hot vaporous refrigerant to enter said inlet of said evaporator to thereby warm said evaporator, thereby causing ice formations formed on said evaporator to be released from said evaporator; and during said harvest cycle, opening a harvest bypass valve disposed intermediate an inlet of a condenser and an inlet port of said compressor, and in communication with said discharge port of said compressor to supply a supplemental quantity of said hot vaporous refrigerant to said compressor to assist said compressor in carrying out said harvest cycle;

maintaining said harvest bypass valve open for a predetermined time; and closing said harvest bypass valve.

6. A method for providing additional refrigerant to a compressor of an icemaker to assist in carrying out a harvest cycle of an icemaking process performed by said icemaker, said method comprising the steps of:

causing said icemaker to enter a harvest cycle in which hot vaporous refrigerant from a discharge port of said compressor is to be directed through an evaporator of said icemaker;

directing said hot vaporous refrigerant to an inlet of said evaporator;

opening a hot gas valve disposed intermediate said discharge port of said compressor and said inlet of said evaporator to enable said hot vaporous refrigerant to enter said inlet of said evaporator to thereby warm said evaporator, thereby causing ice formations formed on said evaporator to be released from said evaporator; and during said harvest cycle, causing a portion of said hot vaporous refrigerant which is contained within a condenser of said icemaker to be injected back into an input port of said compressor for a predetermined time period during said harvest cycle.

7. A method of claim 6, further comprising the steps of:

interrupting the flow of said hot vaporous refrigerant from said condenser to said input port of said compressor after said predetermined time period has expired.

8. The method of claim 6, further comprising the step of:

monitoring the discharge temperature of said compressor; and determining, based on said predetermined discharge temperature, the amount of time said hot vaporous refrigerant in said condenser is to be directed back into said input port of said compressor.

9. An icemaker comprising:

a condenser having an inlet;

a compressor having a discharge port and at least one input port for supplying hot vaporous refrigerant from said discharge port to said inlet of said condenser;

at least one evaporator having an inlet for receiving refrigerant from said condenser, said refrigerant being used to chill said evaporator;

a hot gas valve disposed between said discharge port of said compressor and said inlet of said evaporator, said hot gas valve being opened during a harvest cycle of said icemaker to cause said hot vaporous refrigerant to be injected into said evaporator during said harvest cycle;

a conduit in communication with said inlet of said condenser and said input port of said compressor;

a harvest bypass valve disposed in said conduit, said harvest bypass valve being opened to permit the flow of said hot vaporous refrigerant from said condenser back into said input port of said compressor during said harvest cycle to thereby supply an additional quantity of said hot vaporous refrigerant to said compressor to assist said compressor in executing said harvest cycle.

10. The icemaker of claim 8, further comprising:

a second conduit coupling said discharge port of said compressor to said inlet of said condenser; and a one-way check valve disposed in said second conduit for permitting the flow of said hot vaporous refrigerant in one direction only through said second conduit towards said inlet of said condenser.

11. The icemaker of claim 10, further comprising a hot gas valve disposed in line with a third conduit for supplying said hot vaporous refrigerant from said discharge port to said evaporator; said third conduit being in communication with said second conduit.

12. The apparatus of claim 10, further comprising a second one-way check valve disposed in a fourth conduit communicating with an outlet of said condenser and an inlet of a receiver, for preventing the flow of said hot vaporous refrigerant out of said inlet of said receiver into said outlet of said condenser and into said input port of said compressor during said harvest cycle.

* * * * *

UNITED STATES PATENT AND TRADEMARK OFFICE

CERTIFICATE OF CORRECTION

PATENT NO. : 5,794,452

DATED : August 18, 1998

INVENTOR(S) : William J. Black, et al

It is certified that error appears in the above-identified patent and that said Letters Patent is hereby corrected as shown below: On the title page, insert in item [56] references:

| U.S. PATENT DOCUMENTS | | |
|---|---|---|
| Document Number | Date | Name |
| 2,534,031 | 12/1950 | Kollsman |
| 2,763,130 | 09/1956 | Henderson |
| 2,907,181 | 10/1959 | Nonomaque |
| 3,014,352 | 12/1961 | Leimbach |
| 3,130,558 | 04/1964 | Gardner |
| 3,213,637 | 10/1965 | Halls |
| 3,280,582 | 10/1966 | Knaebel |
| 3,316,731 | 05/1967 | Quick |
| 3,343,375 | 09/1967 | Quick |
| 3,350,893 | 11/1967 | Cable |

UNITED STATES PATENT AND TRADEMARK OFFICE

CERTIFICATE OF CORRECTION

PATENT NO. :5,794,452

DATED :August 18, 1998

INVENTOR(S) : William J. Black, et al.

It is certified that error appears in the above-identified patent and that said Letters Patent is hereby corrected as shown below: On the title page, insert in item [56] references:

| U.S. PATENT DOCUMENTS | | |
|---|---|---|
| 3,386,259 | 06/1968 | Kirkpatrick |
| 3,633,378 | 01/1972 | Toth |
| 4,009,594 | 03/1977 | Swanson |
| 4,326,868 | 04/1982 | Ozu et al |
| 4,688,392 | 08/1987 | Fujimoto et al |
| 4,774,815 | 10/1988 | Schlosser |
| 4,854,130 | 08/1989 | Naruse et al |
| 4,878,361 | 11/1989 | Kohl et al |
| 4,907,422 | 03/1990 | Kohl et al |
| 4,949,551 | 08/1990 | Gregory |
| 5,381,665 | 01/1995 | Tanaka |
| 5,555,744 | 09/1996 | Hirano |

Signed and Sealed this

Ninth Day of March, 1999

*Attest:*

Q. TODD DICKINSON

*Attesting Officer*

*Acting Commissioner of Patents and Trademarks*